US005868127A

United States Patent [19]

Chiang et al.

[11] Patent Number: 5,868,127

[45] Date of Patent: Feb. 9, 1999

[54] NET DEVICE FOR SMOKE EXHAUSTER

[76] Inventors: Chao Cheng Chiang; Chi Shyong Chiang, both of P.O. Box 63-151, Taichung, Taiwan

[21] Appl. No.: 928,132

[22] Filed: Sep. 12, 1997

[51] Int. Cl.[6] ..... F24C 15/20

[52] U.S. Cl. ..... 126/299 D; 416/247 R

[58] Field of Search ..... 55/467; 126/299 R, 126/299 D; 454/49, 67; 416/247 R

[56] References Cited

U.S. PATENT DOCUMENTS

| | | | |
|---|---|---|---|
| 3,199,435 | 8/1965 | Jenson | 126/299 D |
| 3,660,969 | 5/1972 | Fox | 55/467 X |
| 5,733,349 | 3/1998 | Wu | 126/299 D X |

FOREIGN PATENT DOCUMENTS

| | | | |
|---|---|---|---|
| 588751 | 12/1959 | Canada | 126/299 D |
| 5-133580 | 5/1993 | Japan | 126/299 D |
| 2 229 378 | 9/1990 | United Kingdom | 126/299 D |

*Primary Examiner*—Harold Joyce

[57] ABSTRACT

A smoke exhauster includes bottom opening for engaging with a fan device and includes a fastener secured beside the opening. A net device has a portion secured to the smoke exhauster opposite to the fastener and includes an ear having a notch for engaging with the fastener and for allowing the ear to be secured to the smoke exhauster without disengaging the fastener from the smoke exhauster. The ear includes an oblong hole communicating with the notch for allowing the fastener to be engaged into the oblong hole.

3 Claims, 4 Drawing Sheets

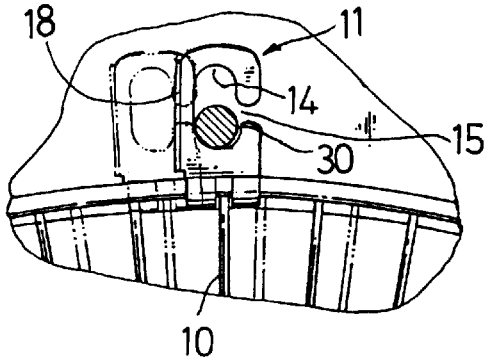
FIG. 7
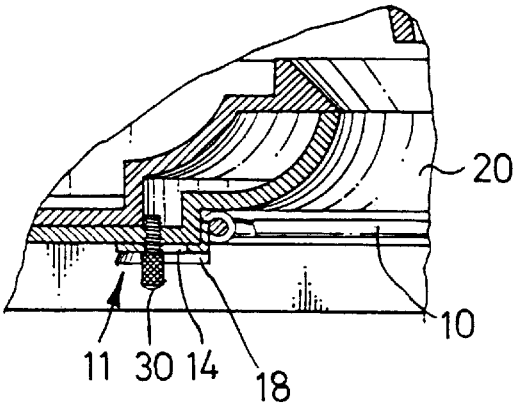
FIG. 6
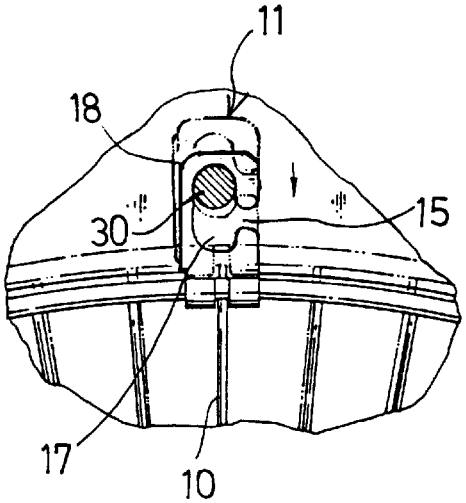
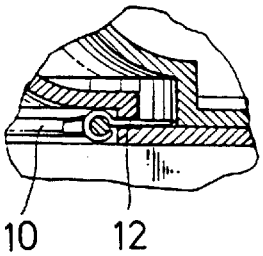
FIG. 5
FIG. 8

NET DEVICE FOR SMOKE EXHAUSTER

BACKGROUND OF THE INVENTION

1. Field of the Invention

The present invention relates to a net, and more particularly to a net device for a smoke exhauster.

2. Description of the Prior Art

Typical smoke exhausters comprise one or two, openings for engaging fan devices and for drafting the smokes. A net device is required to be secured to the bottom of the smoke exhauster for protecting the fan device. The smoke and the vaporized oil or grease or fat may be drawing through the net device such that the net device may easily become greasy and oily and should be cleaned frequently. However, two or more fasteners solidly secure the net device to the smoke exhauster and may not be easily removed for cleaning purposes.

The present invention has arisen to mitigate and/or obviate the afore-described disadvantages of the conventional smoke exhausters.

SUMMARY OF THE INVENTION

The primary objective of the present invention is to provide a smoke exhauster having a net device that may be easily disengaged for cleaning purposes.

In accordance with one aspect of the invention, there is provided a smoke exhauster comprising a body including a bottom opening for engaging with a fan device, a fastener secured to the body and located beside the opening. A net device has a portion secured to the body opposite to the fastener and includes an opposite portion having a notched ear for engaging with the fastener and for allowing the ear to be secured to the fastener without disengaging the fastener.

The ear includes an oblong hole communicating with the notch allowing the fastener to be engaged into the oblong hole and the ends of the oblong hole. The ear includes a handle for facilitating an engagement of the notch of the ear with the fastener. The body includes an annular shoulder formed beneath the opening for engaging with the net device.

Further objectives and advantages of the present invention will become apparent from a careful reading of a detailed description provided hereinbelow, with appropriate reference to accompanying drawings.

BRIEF DESCRIPTION OF THE DRAWINGS

FIGS. 5 and 6 are enlarged partial cross sectional views illustrating the installation of the net device of the smoke exhauster;

FIGS. 7 and 8 are enlarged partial bottom views illustrating the installation of the net device.

DETAILED DESCRIPTION OF THE PREFERRED EMBODIMENT

Figure 1:
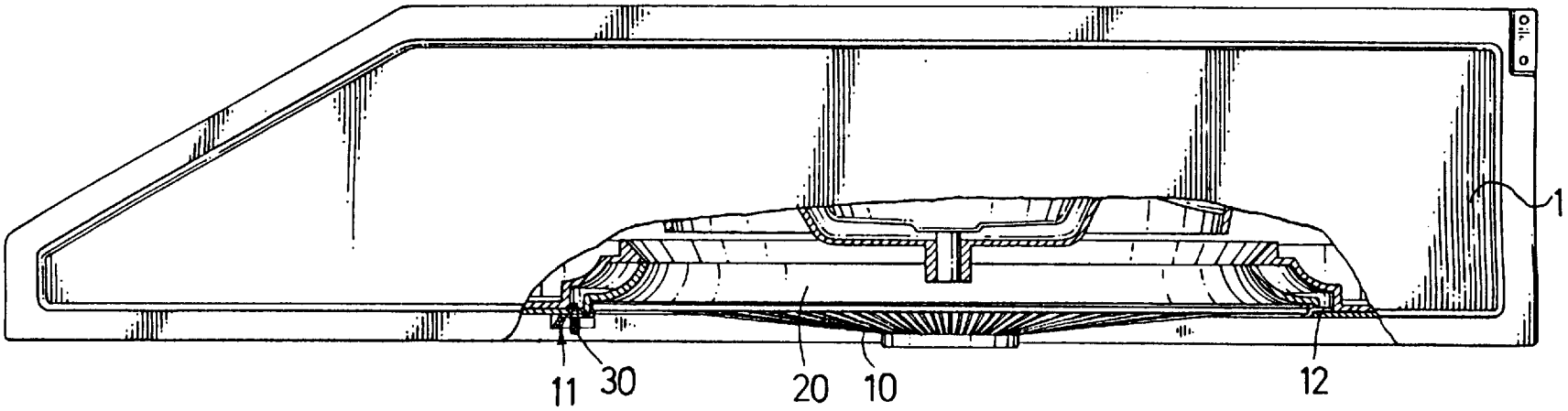
FIG. 1 is a side view of a smoke exhauster, in which a portion of the smoke exhauster is cut off for showing the interior of the smoke exhauster.
Figure 2:
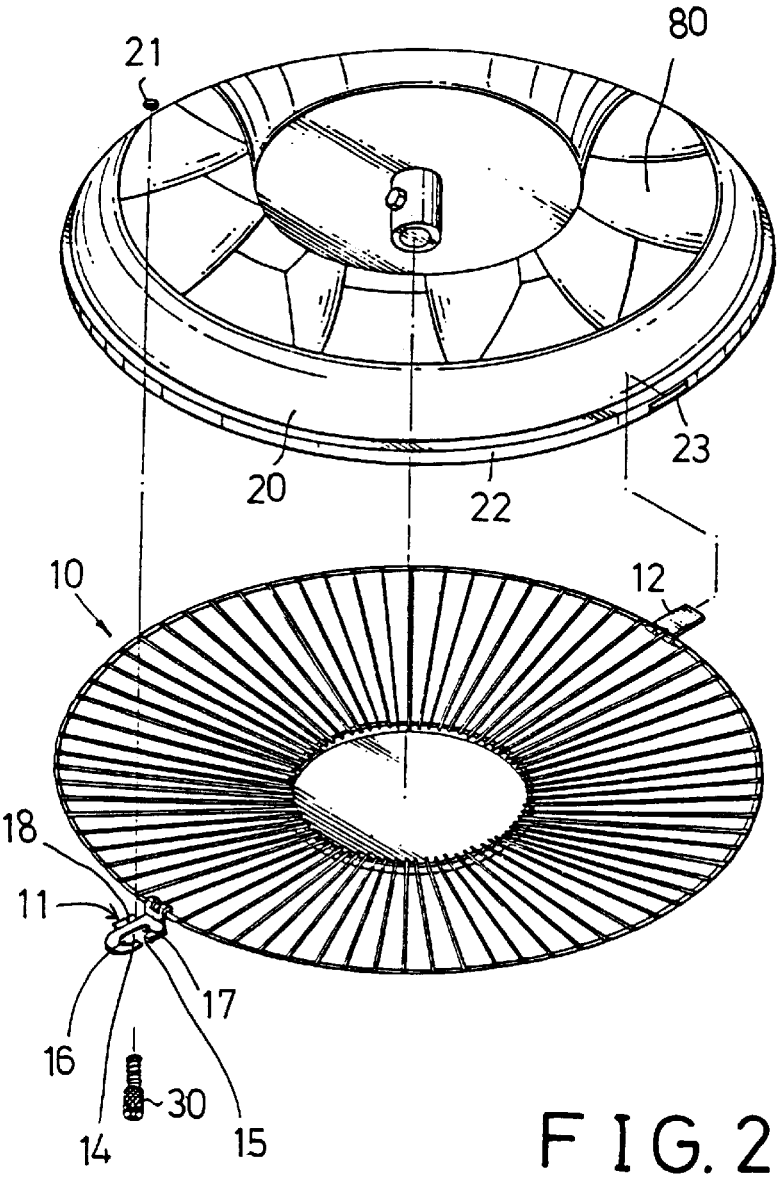
FIG. 2 is a partial exploded view of the smoke exhauster.

Referring to the drawings, and initially to FIGS. 1–4, a smoke exhauster comprises a body 1 including one or more openings 20 formed in the bottom for engaging with fan devices 80 and including an annular shoulder 22 formed in the bottom portion of the body 1 and formed beneath each of the openings 20 for engaging, with a net device 10. The body 1 includes a cavity 23 for engaging with a projection 12 of the net device 10 (FIG. 5) and includes a screw hole 21 formed in the other side of the opening 20 opposite to the cavity 23 for engaging with a fastener 30, such as a screw, a bolt or a quick release member. The net device 10 may be pivotally coupled to the body 1 by the projection 12 and may thus be rotated relative to the body 1 about the projection 12. The net device 10 includes an ear 11 extended radially outward opposite to the projection 12 for engaging with the fastener 30. The ear 11 includes an oblong hole 14 having two ends 16,17 and includes a notch 15 communicating with the oblong hole 14 (FIGS. 4 and 6) for allowing the fastener 30 to be easily engaged into the oblong hole 14 without disengaging the fastener 30 from the body 1. It is preferable that the ear 11 includes a rib 18 for forming as a handle and for allowing the ear 11 to be easily rotated by the finger of the user. The projection 12 may be considered as one end of the net device 10 and the ear 11 may be considered as the other end of the net device 10.

In operation, as shown in FIGS. 7 and 8, the fastener 30 may be easily engaged into the oblong hole 14 via the notch 15 without disengaging the fastener 30 from the body 1. In addition, the sliding engagement of the projection 12 in the cavity 23 allows the net device 10 to be moved relative to the body 1 for engaging the fastener 30 with either of the ends 16, 17 of the oblong hole 14 and for allowing the fastener 30 to solidly secure the ear 11 to the body 1.

It is to be noted that net device 10 is normally greasy and oily when it is required to be cleaned. The ear 11 may be easily disengaged from the fastener 30 when the fastener 30 is unthreaded or loosened relative to the body 1 without being disengaging the fastener 30 from the body 1. It is normally required to rotate the fastener 30 for about one turn in order to allow the ear 11 to be disengaged from the fastener 30. In addition, when it is required to assemble the net device 10, it is only required to engage the projection 12 into the cavity 23 and to engage the ear with the fastener 30 again. The fastener 30 may be easily engaged into the oblong hole 14 via the notch 15 for allowing the net device to be easily secured in place again by the fastener.

It is further to be noted that, in some cases, it is not required to remove the net device and it is only required to rotate the net device 10 away from the opening 20 for allowing the user to remove the fan device 80 for cleaning purposes. In this circumstance, the projection 12 may include a hole for engaging with a fastener that is secured to the body 1 and for allowing the net device 10 to be pivotally secured to the body 1 at a pivot shaft. The fastener 30 may also be easily engaged into and disengaged from the oblong hole 14 for allowing the net device 10 to be rotated about the pivot shaft and to be rotated away from the opening 20 for allowing the fan device 80 to be easily removed for cleaning purposes.

Figure 9:
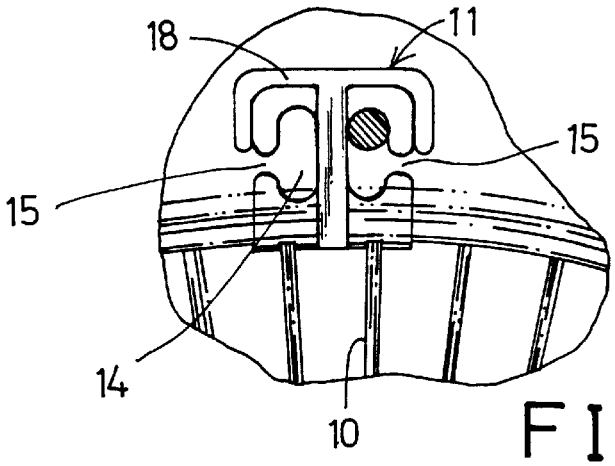
FIG. 9 is a partial bottom view similar to FIGS. and 8, illustrating another application of the ear of the net device.
Figure 3:
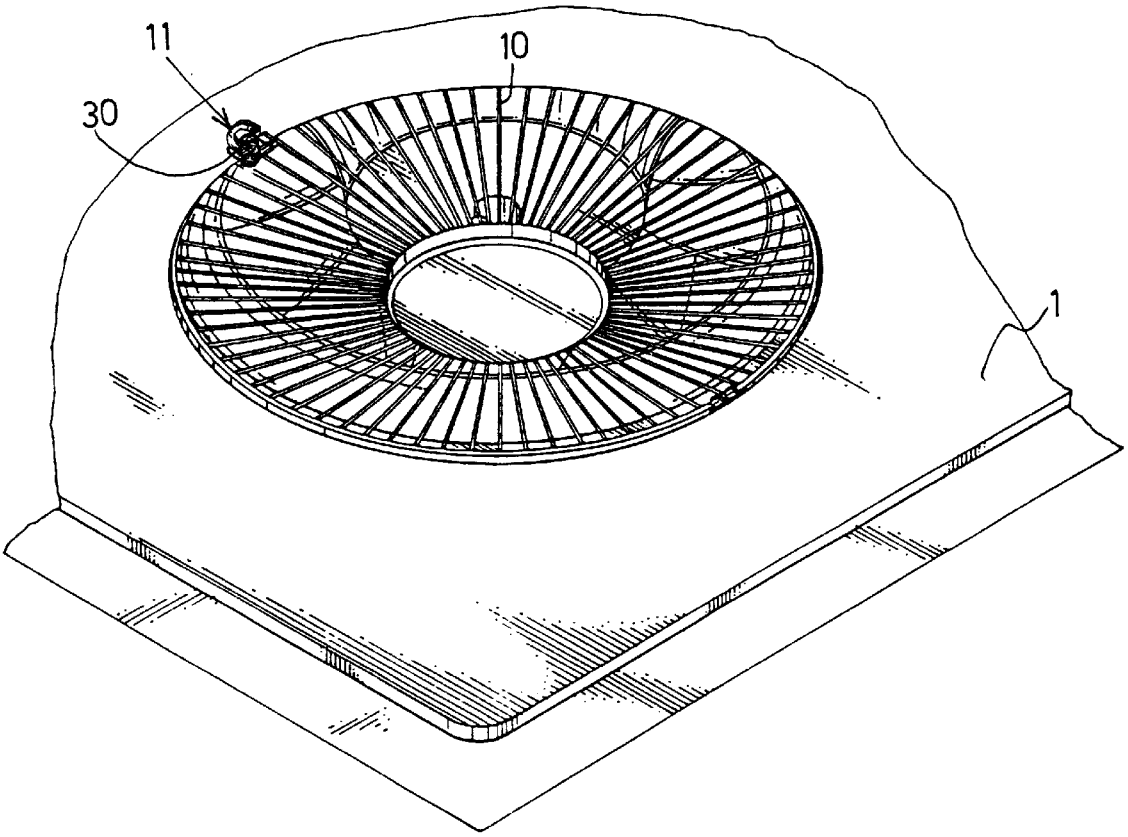
FIG. 3 is a partial bottom perspective view of the smoke exhauster.
Figure 4:
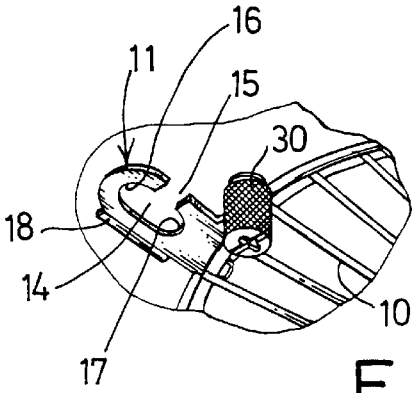
FIG. 4 is an enlarged partial bottom perspective view of the smoke exhauster.

Alternatively, as shown in FIG. 9, the ear 11 may include a pair of opposite notches 15 and two oblong holes 14 for forming two C-shaped members and for allowing the ear 11 to engage with the fastener 30 from either side of the ear 11. The rib or the handle 18 may be formed as T-shape or any other shapes having a size good enough for allowing the user to rotate the net device.

Accordingly, the smoke exhauster in accordance with the present invention includes a net device that be easily removed for cleaning purposes, without disengaging the fastener.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A smoke exhauster comprising:

a body including a bottom portion having at least one opening for engaging with a fan device and having a cavity formed beside said at least one opening, a fastener secured to said body and located beside said at least one opening and opposite to said cavity, and a net device including a first portion having an extension slidably engaged in said cavity of said body and including a second portion having an ear for engaging with said fastener, said ear including a notch for engaging with said fastener and for allowing said ear to be secured to said body without disengaging said fastener from said body, said ear including an oblong hole having two ends, said notch being communicating with said oblong hole for allowing said fastener to be engaged into said oblong hole and for allowing said fastener to be adjusted relative to said ear and to be engaged with said ends of said oblong hole before said fastener secure said ear of said net device to said body.

2. The smoke exhauster according to claim 1, wherein said ear includes a handle for facilitating an engagement of said notch of said ear with said fastener.

3. The smoke exhauster according to claim 1, wherein said body includes an annular shoulder formed in said bottom portion of said body and formed beneath said at least one opening for engaging with said net device.

* * * * *